US008827125B2

(12) United States Patent
Xie

(10) Patent No.: US 8,827,125 B2
(45) Date of Patent: Sep. 9, 2014

(54) CLOTHING HOLDERS

(75) Inventor: Xiaoling Xie, Hong Kong (CN)

(73) Assignee: Auyeung Mo, Hong Kong (CN)

( * ) Notice: Subject to any disclaimer, the term of this patent is extended or adjusted under 35 U.S.C. 154(b) by 0 days.

(21) Appl. No.: 13/808,294

(22) PCT Filed: Aug. 8, 2011

(86) PCT No.: PCT/IB2011/053528
§ 371 (c)(1),
(2), (4) Date: Jan. 4, 2013

(87) PCT Pub. No.: WO2012/069937
PCT Pub. Date: May 31, 2012

(65) Prior Publication Data
US 2013/0228598 A1 Sep. 5, 2013

(51) Int. Cl.
*A47G 25/60* (2006.01)
*A41D 27/22* (2006.01)

(52) U.S. Cl.
USPC ..... 223/86

(58) Field of Classification Search
USPC ..... 223/85–98; 211/113; D6/315, 326, 328
See application file for complete search history.

(56) References Cited

U.S. PATENT DOCUMENTS

| | | | | | |
|---|---|---|---|---|---|
| 1,168,741 | A * | 1/1916 | Potter | 223/86 |
| 1,615,748 | A * | 1/1927 | Fischer | 223/86 |
| 1,981,072 | A * | 11/1934 | Roman et al. | 223/86 |
| 2,187,691 | A * | 1/1940 | Newhouse | 223/86 |
| 2,417,397 | A * | 3/1947 | McCarthy | 223/86 |
| 2,529,294 | A * | 11/1950 | Hammond, Jr. | 223/86 |
| 2,601,074 | A * | 6/1952 | Walton | 223/86 |
| 7,927,542 | B2 * | 4/2011 | Di Bono et al. | 422/5 |
| 2011/0233347 | A1 * | 9/2011 | Turvey et al. | 248/95 |

* cited by examiner

*Primary Examiner* — Ismael Izaguirre
(74) *Attorney, Agent, or Firm* — Jackson IPG PLLC

(57) ABSTRACT

A holder for holding a clothing or apparel article, the holder comprises a main body for supporting a clothing article and a plug-in module carrying a scent treatment substance. The scent treatment substance is adapted for scent emission and/or odor absorption. The plug-in module is adapted to disseminate scent to the ambient and/or to absorb odor from the ambient so that scent can be disseminated by the holder to the clothing item supported on the holder or odor can be absorbed from the ambient.

10 Claims, 3 Drawing Sheets

CLOTHING HOLDERS

FIELD OF THE INVENTION

The present invention relates to holders, and more particularly to clothing or apparel holders such as clothing racks and cloth hangers.

BACKGROUND OF THE INVENTION

Holders are widely used for hanging or supporting articles such as clothing or apparels. Clothing articles are typically stored in a closed environment such as wardrobes or closets when not in use. As the storage may be for an extended period of time, the articles may absorb unpleasant scents or the unpleasant scents already absorbed prior to storage may not disperse.

SUMMARY OF THE INVENTION

There is provided a holder for holding a clothing or apparel article. The holder comprises a main body for supporting a clothing article and a plug-in module carrying a scent treatment substance. The scent treatment substance is adapted for scent emission and/or odor absorption, and the plug-in module is adapted to disseminate scent to the ambient and/or to absorb odor from the surrounding ambient. This holder is advantageous because smelly residual odor on a clothing article or in a closed storing environment could be mitigated and/or pleasant scent could be imparted onto the clothing article.

The main body may comprise a receptacle which defines a window compartment for detachably receiving the plug-in module. Such an arrangement permits removal or exchange of the plug-in module as and when necessary to extend the usable life of the holder.

The window compartment may extend through the main body and the receptacle is arranged such that opposite major surfaces of the plug-in module are outwardly facing when the plug-in module is received by the receptacle, and wherein the opposite major surfaces are surfaces through which scent is emitted from the plug-in module or through which odor is absorbed by the plug-in module.

This enhances scent dissemination and/or odor absorption effectiveness.

The plug-in module may comprise a container inside which a scent treatment substance is stored, and wherein at least one outwardly facing major surfaces of the container is perforated to permit emission of scent or absorption of odor. This permits refill or replacement of the scent treatment substances. The oppositely facing major surfaces of the plug-in module may be perforated.

It is appreciated that the perforations enhance scent treatment effects. To mitigate leaking or spillage, the scented substance may be in solid or semi-solid gel, wax or pad form.

In an example, the main body and the plug-in module may comprise corresponding stop portions, the corresponding stop portions being arranged to interact to limit the plug-in depth relative to the main body. The corresponding stop portions, preferably complementarily shaped, operate to bring the plug-in module into an aligned position with respect to the main body upon insertion by a user. The aligned position is preferably arranged such that the plug-in module does not protrude or project from the main body.

The plug-in module may comprise a lidded container and a first stop portion part, the first stop portion part comprising a tab which projects laterally away from the lid of the container.

The tab as a stop portion also serves a second function as a finger tip engaging means to facilitate removal of the plug-in module when required.

The lidded container comprises a hinge such that the lid is moveable between open and closed positions about the hinge, the hinge projecting laterally away from the container and forming a second stop portion part of the plug-in module. The hinge, preferably elongate and more preferably integrally moulded on the container, while operating as a hinged connection between the lid and the main body of the container, also serve a secondary function as a stop portion. A stop means having dual functions facilitate a more compact plug-in module as well as cost reduction.

The stop portion on the main body may be indented and defining recesses, the recesses being shaped to complementarily receive the stop portion on the plug-in module. The complementarily shaped stop portions on the main body and the plug-in module facilitate self-alignment between corresponding parts, thereby facilitating a convenient snap-fit insertion of the plug-in module for user convenience.

The depth of the recesses may be such that the stop portion on the plug-in module is flush with or below the surface of the main body when the plug-in module is received by the receptacle.

The window compartment of the receptacle may be adapted for frictionally holding the plug-in module. For example, the peripheral wall of the window compartment may be coated with or covered by a soft frictional material for frictionally holding the plug-in module.

In another aspect, there is provided a plug-in module carrying a scent treatment substance for use with a cloth hanger or clothing holder, wherein the plug-in module is adapted for snap-fit attachment onto a receptacle on the cloth hanger or clothing holder.

Stop portions may be formed on the plug-in module, the stop portions being adapted to interact with corresponding stop portions on the receptacle on the cloth hanger or clothing holder to restrict the depth of movement into the receptacle.

One of the stop portions may be a tab adapted for engaging a finger-tip of a user to facilitate removal of the plug-in module from the receptacle when mounted therein.

One of the stop portions may be an elongate hinge on the plug-in module.

The plug-in module may comprise a container filled with a scent treatment substance, the container being perforated to disseminate scent to the ambient and/or to absorb odor from the ambient.

The container may be lidded, and the finger engaging tab may be formed on a side edge of the lid.

BRIEF DESCRIPTION OF DRAWINGS

Embodiments of the present invention will be explained below by way of example and with reference to the accompanying drawings or figures, in which:—

DETAILED DESCRIPTION OF PREFERRED EMBODIMENTS

Figure 1:
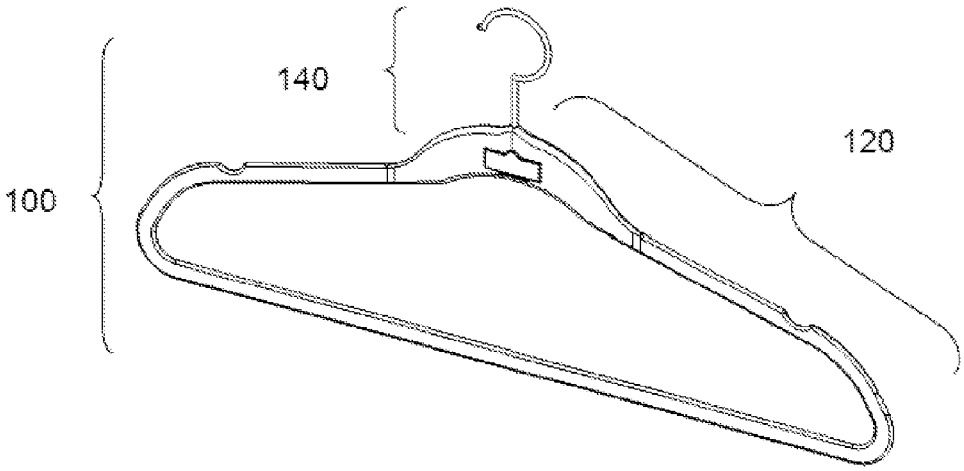
FIG. 1 is a perspective view showing a cloth hanger illustrating an example of a clothing holder.
Figure 2:
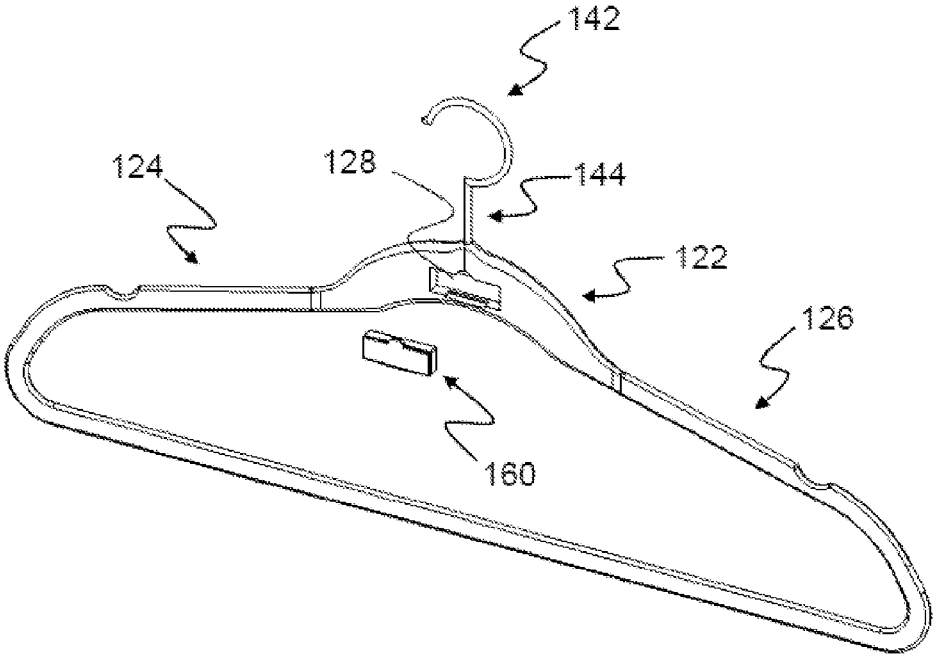
FIG. 2 is a perspective view showing the cloth hanger of FIG. 1 with a plug-in module detached.
Figure 2A:
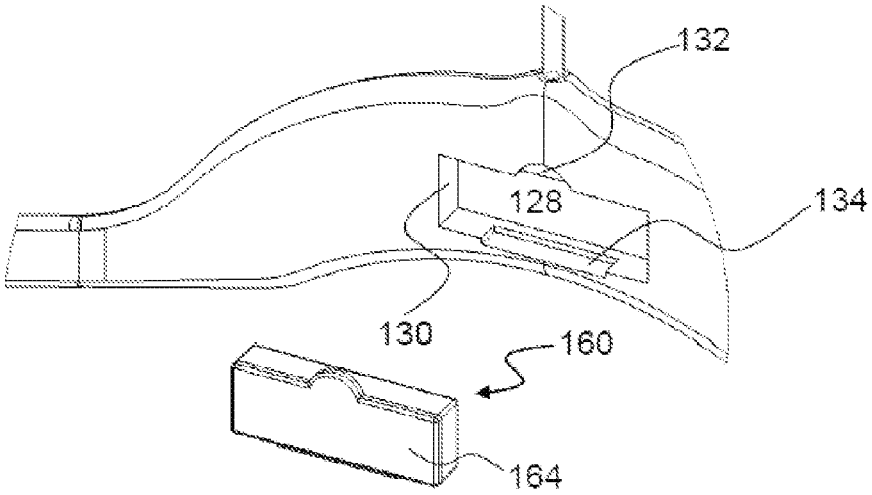
FIG. 2A is an enlarged perspective view of a central portion and the plug-in module of the cloth hanger of FIG. 2.

An example cloth hanger 100 of FIGS. 1 and 2 illustrates a non-limiting example of a holder, such as a clothing holder or a clothing rack. The cloth hanger 100 of FIG. 1 comprises a main body 120 and a hanging head 140 for attaching the cloth hanger to a support rail (not shown). The main body 120 is made of plastics and comprises a central portion 122 which is intermediate two laterally extending wing portions 124, 126. The central portion and the lateral wing portions are integrally moulded or formed as a single piece. Exemplary materials suitable for forming the main body include hard plastics, aluminum alloy or wood. The laterally extending wing portions form a shoulder portion of the cloth hanger and each wing portion slopes slight downwards as it extends laterally away from the central portion.

The hanging head is centrally mounted on the central portion and extends vertically upwards from the central portion. The hanging head comprises a curved hook portion 142 which is connected to the central portion via a straight neck portion 144. The head portion is vertically above the center of gravity (CG) of the main body such that the wing portions are substantially symmetrical about a vertical line passing through the head portion when freely suspended with the curved hook portion hanged on a rail. The head portion is rotatable about the neck portion as a swivel axis so that the angular orientation of the main body with respect to the curved hook portion is variable by relative rotation between the main body and the head portion.

Figure 3:
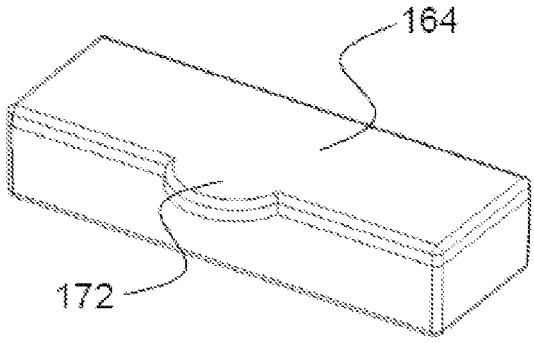
FIG. 3 is a first perspective view of the plug-in module.

As shown more clearly in FIGS. 2 and 3, a receptacle is formed on the central portion and vertically below the head portion. The receptacle comprises a compartment 128 which is adapted for receiving a plug-in module 160. The plug-in module is adapted for receiving scent generating substances such as a gel or pad of fragrance or essential oil, or odor absorption substances, such as activated charcoal powder or bamboo powder. For the sake of brevity, scent generating substances, and odor absorption substances or the like, are collectively referred to as scent treatment substances herein unless the context requires otherwise. The compartment is shaped and dimensioned for a closely-fitted reception of the plug-in module so that the plug-in module can stay in an operation position after insertion, and can be inserted or removed by hand without using a tool.

The compartment is defined by a peripheral wall 130 which forms an outer boundary of a window within which the plug-in module 160 is detachably received. The window penetrates through the central portion to define a through window bore so that both major surfaces of the through window can be utilized for scent operation. Shallow recesses 132, 134 are formed on opposite edges of the peripheral wall to accommodate stop portions formed on corresponding edges on the plug-in module. Each recess is formed on the central portion and comprises a shallow shelf which extends laterally away from the peripheral wall. The shallow recess does not pass through the main body and is provided such that a plug-in module comprising a pair of laterally extending wing portions is prevented from exiting from a side opposite to the side of insertion due to blockage by the portion of the main body underlying the shallow shelf. The shallow shelves collectively define stop portions on the main body to interact with corresponding stop portions of the plug-in module to limit movement of the plug-in module into the receptacle. The depth of the shelf below the main body surface is arranged such that the respective outer surfaces of the stop portions of the plug-in module are flush or below with the main body surface. In this example, the depth of the indentations is about one-third of the thickness of the central portion.

The peripheral wall is covered with a fabric-like or frictional material such as velvet, or coated with distributed rubber or silicone dots to enhance smooth frictional engagement with the plug-in module. The coating or covering may extend to other portions of the cloth hanger, especially the portions which are in contact with clothing articles when in use.

Figure 3A:
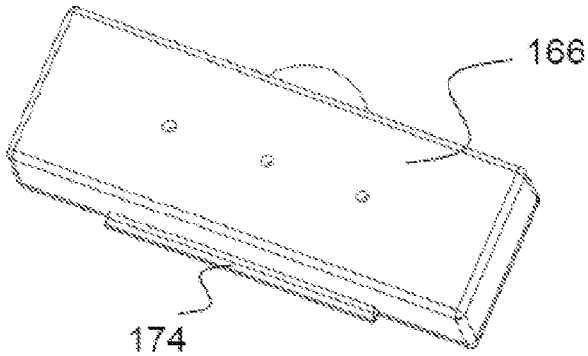
FIG. 3A is a second perspective view of the plug-in module.

The plug-in module 160 is detachable from the main body 120 and comprises an integrally moulded container. The container comprises a housing body which defines a compartment 162 for carrying scent emitting substances or scent absorbing substances. Distributed perforations are formed on major surfaces 164, 166 of the container to allow scent or odor passage. The container is shaped and arranged such that its perforated surfaces are exposed when the plug-in module is duly received within the receptacle on the main body. More particularly, the perforated surfaces are outwardly facing to enhance scent absorption or emission area. The example container of FIGS. 3 and 3A is mouled of clear plastics so that the level of scent absorption or emission substances stored in the plug-in module can be visually inspected and monitored while mounted on the receptacle. The container is lidded to permit refill, replenishing or replacement of the scent treatment substances.

Figure 4:
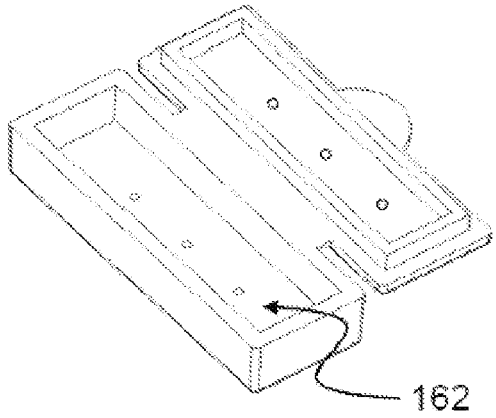
FIGS. 4 and 4A are respectively first and second perspective views of the plug-in module with lid opened.
Figure 4A:
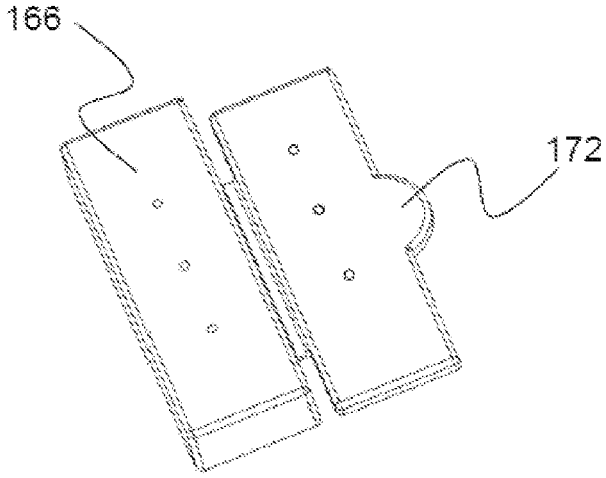
Figure 4B:
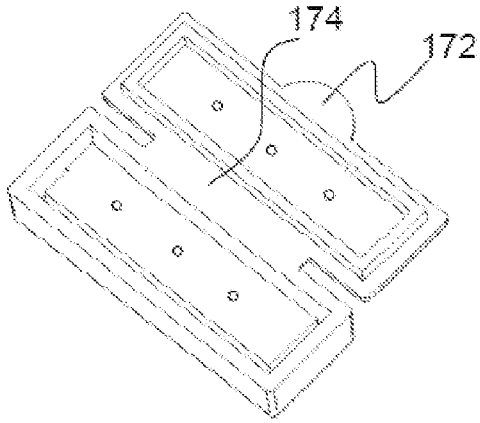
FIG. 4B is a perspective view of the plug-in module of FIG. 4 filled with scent emitting or scent absorbing substances.

As shown in FIGS. 4, 4A and 4B, a laterally extending tab 172 is formed on the top cover of the container. This tab is provided to receive a fingertip of a user to enable a user to open the container lid as well as to push and press the container in position into the receptacle. Incidentally, this tab also forms a stop portion which interacts with the shelf on the main body to limit advancement of the container through the receptacle after insertion. In addition, this lid is connected to the housing body via an elongate hinge 174. The elongate hinge is moulded on the housing body and projects laterally outwards from the housing body. Incidentally, this elongate lid forms another stop portion on the plug-in module. As the elongate hinge and the tab are on opposite major sides of the plug-in module, stop portions are therefore also distributed on opposite major sides of the plug-in module to provide a balanced stop arrangement.

The overall thickness of the plug-in module is arranged such that when the plug in module is duly placed in the receptacle, the major or perforated surfaces of the plug-in module are flush with or below the surfaces of the main body of the cloth hanger to mitigate contact induce damage to the clothing articles.

In use, a user inserts a plug-in module filled with scent treatment substance into the receptacle and press the plug-in module firmly against the main body to ensure due retention by the receptacle. The scent treatment substances inside the compartment of the plug-in module emit scent or absorbs odor via the perforations on the major surfaces of the plug-in module to condition the clothing articles supported by the cloth hanger.

When a plug-in module is to be removed, a user applies a finger tip against the tab portion, tilt it and lift the plug-in module to remove it. The user can then refill, replenish, or change the scent treatment substances after removal and then return the plug-in module into the receptacle. Alternatively, a user may simply remove and change another plug in module or to dispose of the plug-in module without replacement as and when desired.

While the tab and elongate hinge also operate as stop portions, it should be appreciated that additional or alternative stop portion can be formed on the plug-in module without loss of generality. In addition, a plug-in module may contain no scent treatment substances when it is desirable to fill up the window on the main body.

The scented substances may be homogenized in wax, gel or compressed block form to mitigate leakage or spillage. Alternatively, the scented substances may be stored on an absorption pad. In a further alternative, the major or outward facing surfaces of the plug-in module may be formed of porous materials to permit odor of scent passage. In a yet further alternative, the plug-in module may be formed of scent treatment substances in which case the plug-in module is a plug-in capsule of scent treatment substances. When in the capsule form, the stop portions may be integrally formed as part of the capsule.

While embodiment of the present invention has been explained with reference to the examples above, the embodiments are non-limiting examples for illustrating the present invention and should not be construed to limit the scope of the invention. For example, while an embodiment has been explained with reference to a rectangular container, it should be appreciated that the rectangular container could be of any appropriate shape such as cylindrical, polygonal or triangular without loss of generality. Furthermore, while the example plug-in module is moulded of clear plastics, it may be formed of other materials without affecting its performance.

What is claimed is:

1. A cloth hanger, comprising a main body, a hanging head and a plug-in module, wherein the main body comprises a central portion and two laterally extending wing portions, the central portion is intermediate the two laterally extending wing portions, the hanging head is centrally mounted on the central portion and extends vertically upwards from the central portion, the hanging head comprises a curved hook portion which is connected to the central portion via a straight neck portion, a receptacle is formed on the central portion and vertically below the hanging head, the receptacle comprises a compartment which is adapted for detachably receiving the plug-in module, the plug-in module comprises a container inside which a scent treatment substance is stored, and at least one outwardly facing major surface of the container is perforated to permit emission of scent or absorption of odor, wherein the compartment of the receptacle is adapted for frictionally holding the plug-in module, wherein the compartment is defined by a peripheral wall, the peripheral wall is coated with or covered by a soft frictional material for frictionally holding the plug-in module.

2. The cloth hanger according to claim 1, wherein the central portion and the lateral wing portions are integrally molded of formed as a single piece.

3. The cloth hanger according to claim 1, wherein the scent treatment substance is in solid or semi-solid gel, wax or pad form.

4. The cloth hanger according to claim 1, wherein the main body and the plug-in module comprise corresponding stop portions, the corresponding stop portions being arranged to interact to limit the plug-in depth relative to the main body.

5. The cloth hanger according to claim 1, wherein the plug-in module comprises a lidded container and a first stop portion part, the first stop portion part comprising a tab which projects laterally away from the lid of the container.

6. The cloth hanger according to claim 4, wherein the stop portion on the main body is indented and defining recesses, the recesses being shaped to complementarily receive the stop portion on the plug-in module.

7. The cloth hanger according to claim 6, wherein the depth of the recesses is such that the stop portion on the plug-in module is flush with or below the surface of the main body when the plug-in module is received by the receptacle.

8. The cloth hanger according to claim 5, wherein the lidded container comprises a hinge such that the lid is moveable between open and closed positions about the hinge, the hinge projecting laterally away from the container and forming a second stop portion part of the plug-in module.

9. The cloth hanger according to claim 8, wherein the hinge is elongate and is integrally formed on the container.

10. The cloth hanger according to claim 1, wherein the receptacle is located on an axis of symmetry or the center of gravity of the main body.

* * * * *